US006201204B1

(12) United States Patent
Raynaud

(10) Patent No.: US 6,201,204 B1
(45) Date of Patent: Mar. 13, 2001

(54) CLOSURE RESISTOR ASSEMBLY FOR HIGH VOLTAGE ELECTRICAL GEAR

(75) Inventor: Bernard Raynaud, Rillieux la Pape (FR)

(73) Assignee: Alstom France SA, Paris (FR)

( * ) Notice: Subject to any disclaimer, the term of this patent is extended or adjusted under 35 U.S.C. 154(b) by 0 days.

(21) Appl. No.: 09/414,313

(22) Filed: Oct. 7, 1999

(30) Foreign Application Priority Data

Oct. 8, 1998 (FR) ..... 98 12621

(51) Int. Cl.[7] ..... H01H 33/16
(52) U.S. Cl. ..... 218/143
(58) Field of Search ..... 200/143, 144, 200/148; 338/113, 200, 215; 218/152–154

(56) References Cited

U.S. PATENT DOCUMENTS

| | | | | |
|---|---|---|---|---|
| 2,724,755 | | 11/1955 | Morgan | 218/2 |
| 5,262,605 | * | 11/1993 | Pham et al. | 218/143 |
| 5,276,285 | * | 1/1994 | Pham et al. | 218/143 |
| 5,661,282 | | 8/1997 | Tsuchiya | 218/145 |

FOREIGN PATENT DOCUMENTS

| | | |
|---|---|---|
| 669 863 A5 | 4/1989 | (CH) . |
| 94 16 993 U | 2/1995 | (DE) . |
| 0 482 555 A1 | 4/1992 | (EP) . |
| 906 954 | 9/1962 | (GB) . |

* cited by examiner

*Primary Examiner*—J. R. Scott
(74) *Attorney, Agent, or Firm*—Sughrue, Mion, Zinn, Macpeak & Seas, PLLC

(57) ABSTRACT

A closure resistor assembly for high voltage electrical gear. The assembly includes a multiplicity of resistive electrical components aligned in a row along an axis, and a mechanism which exerts a compression force on the electrical components along the axis so as to maintain electrical contact between them. The mechanism for exerting the compression force includes a rigid tube within which the electrical components are stacked, and an energy-storing floating structure placed inside the tube at one end of the row of electrical components. The floating structure is constituted by a first piece disposed between the end of the row of electrical components and a second piece that is mounted in a fixed manner inside the tube, together with a spring that is kept in compression between the first and second pieces. The first piece is also mounted so as to be semi-moving between two abutments that are spaced-apart along the axis D.

4 Claims, 1 Drawing Sheet

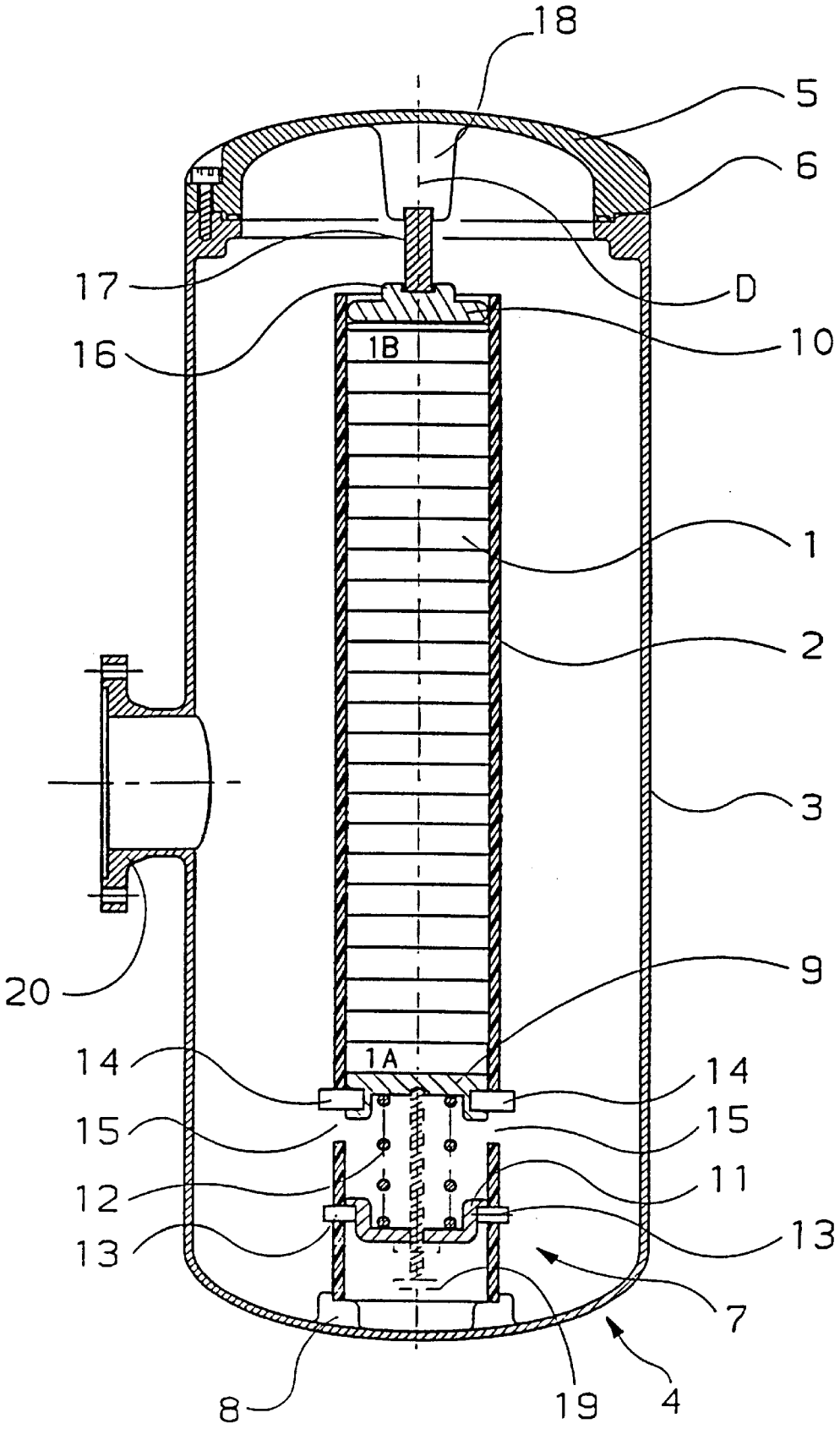
18
5
6
17
D
16
10
1B
1
2
3
20
9
14
1A
14
15
15
12
11
13
13
7
8
19
4

CLOSURE RESISTOR ASSEMBLY FOR HIGH VOLTAGE ELECTRICAL GEAR

The present invention relates to a closure resistor assembly for high voltage electrical gear, the assembly comprising a multiplicity of resistive electrical components aligned in a row along an axis, and a mechanism for exerting a compression force on the electrical components along the axis so as to maintain electrical contact between them.

BACKGROUND OF THE INVENTION

Such an assembly is designed to be fixed at the end of a break chamber in a compressed gas circuit-breaker, for example, in order to reduce the effects of high currents during closure of the circuit-breaker by inserting the resistor in the electrical circuit of the circuit-breaker.

Until now, the electrical components forming the closure resistor which are in the form of resistor disks, have been stacked inside a metal case mounted at the end of the break chamber which is vertical and said row of electrical components has generally been mounted in such a manner as to extend along the axis of the break chamber. At one end of the stack of electrical components, there is placed a spring which is put into compression by a cover which is fixed on an end opening of the case.

For a break chamber that is mounted in a horizontal position, such a disposition for the closure resistor takes up space and gives rise to a bending moment at the end of the break chamber because of the considerable length and the mass of the closure resistor, and difficulties are encountered with applying compression to the electrical components inside the case because of the risk of the compression spring expanding before the cover has been finally fixed to the case.

OBJECTS AND SUMMARY OF THE INVENTION

An object of the invention is to remedy those various drawbacks.

To this end, the invention provides a closure resistor assembly for high voltage electrical gear, the assembly comprising a multiplicity of resistive electrical components aligned in a row along an axis, and a mechanism which exerts a compression force on the electrical components along the axis so as to maintain electrical contact between them, wherein the mechanism for exerting said compression force comprises a rigid tube within which the said electrical components are stacked, and an energy-storing floating structure placed inside the tube at one end of the row of electrical components, said floating structure being constituted by a first piece disposed between said end of the row of electrical components and a second piece that is mounted in fixed manner inside the tube, together with a spring that is kept in compression between the first and second pieces, said first piece also being mounted so as to be semi-moving between two abutments that are spaced-apart along the axis D.

With such an arrangement, the electrical components are compressed along the axis D merely by exerting an axially-directed force on the other end of the row of electrical components against the force exerted by the spring on the first piece, so as to make use of the energy of the floating structure without any risk of it being ejected. This pressure can be exerted by the cover of a case inside which the tube loaded with electrical components is placed.

In addition, in accordance with the invention, the row of electrical components is fixed to the end of the break chamber of electrical gear in such a manner as to extend perpendicularly to the break chamber so as to reduce the lever arm effect.

BRIEF DESCRIPTION OF THE DRAWING

An embodiment of the resistor assembly of the invention is described below in greater detail and is shown in the sole FIGURE which is a highly diagrammatic longitudinal section of such a closure resistor assembly.

DETAILED DESCRIPTION OF THE PREFERRED EMBODIMENT

In the FIGURE, the closure resistor assembly comprises a multiplicity of resistive electrical components 1 of the resistor block type which are aligned in a row along an axis D inside a rigid tube 2 of electrically insulating material.

The tube 2 is placed inside a metal case 3 that is generally cylindrical in shape, extending longitudinally along the axis D and designed to be mounted to the end of the break chamber of a piece of high voltage electrical gear such as a compressed gas circuit-breaker. In the FIGURE, the tube 2 is placed between the end wall 4 of the case and a cover 5 which closes the case in a sealed manner by means of a gasket 6.

The end 7 of the tube 2 rests in a depression formed in a projection 8 on the end wall of the case, thereby holding said tube centered inside the case.

A first electrically-conductive metal plate 9 is placed inside the tube against the first electrical component 1A of the stack, in electrical contact therewith, and a second metal plate 10 is placed inside the tube against the last electrical component 1B of the stack, in electrical contact therewith. The two plates 9 and 10 preferably constitute inlet and outlet terminals for the current flowing through the closure resistor.

When the cover 5 closes the case 3, an axial compression force is exerted on the two plates 9 and 10 and on the electrical components 1 to maintain good electrical contact between them.

This compression force is produced firstly by an energy-storing floating structure mounted inside the tube at the end 7 of the tube which rests on the end wall of the case. More particularly, this floating structure is constituted by the plate 9, by another plate 11 optionally made of metal and disposed inside the tube, being axially spaced apart from the plate 9 inside the tube, and a compression spring 12 that is kept compressed between the plates 9 and 11. The plate 9 which is in contact with the first electrical component 1A of the stack is also mounted to be semi-moving along the axis D inside the tube relative to the plate 11 which is fixed in the tube.

As can be seen in the FIGURE, starting from the end 7 of the tube, the bottom face of the plate 11 is in abutment on studs 13 which pass through orifices provided in the wall of the tube 2 and which extend into the tube beneath the bottom edge of the plate 11. It should be observed that the top face of the plate 11 has a kind of central depression within which one end of the spring 12 is engaged, this depression serving to center the spring 12 on the axis D.

The plate 9 also has a bottom surface opposite from its surface in contact with the electrical component 1A, which bottom surface has a central depression in which the other end of the spring 12 is engaged. The plate 9 is mounted to have limited movement (i.e., be semi-moving) along the axis D by being secured to studs 14 passing through respective slots 15 provided in the tube 2, each slot extending longitudinally along the axis D to allow the stud 14 to move a certain distance between two ends which are spaced apart along the axis D. As can be seen in the FIGURE, the studs 14 are inserted into the thickness of the plate 9. The spring is kept compressed between the plates 9 and 11 whatever the position of the plate 9 between the two ends of the slots 15.

The top face of the plate 10 has a projection 16 with a central recess in which one end of a stud 17 is engaged. The bottom face of the cover 5 also has a projection 18 with a central recess in which the other end of the stud 17 is engaged. The length of the stud 17 along the axis D is adjusted in such a manner that when the cover 5 is fixed to the case 3, the plate 10 is pushed a little way along the axis D so as to displace the plate 9 between the two ends of the slots 15 so as to make use of the energy of the spring 12 and put the stack of electrical components under compression due to the compression force from the spring 12.

With this arrangement, the tube 2 is not subjected to bending since substantially all of the compression force is localized in the end 7 of the tube. The major portion of the tube 2 therefore serves solely to hold the electrical components 1 of the stack, and as a result the tube can be of relatively lightweight structure and can be low in cost.

The number of electrical components in the tube can be greater or smaller depending on the desired resistance, but the axial compression to which the stack of electrical components is subjected can be determined simply by adjusting the length of the stud 17 along the axis D, which can be done particularly cheaply.

With the arrangement of the invention, the stack of electrical components 2 can be constituted outside the case as follows. Starting with an empty tube 2, the plate 9 is initially mounted in the tube with the studs 14 engaged in the slots 15. Thereafter, the spring 12 is placed between the plate 9 and the plate 11. The spring 12 is then compressed between these two plates by means of a screw 19 which engages in the thickness of the plate 9 and which passes through the plate 11, the screw 19 being operated to move the two plates towards each other until it is possible to insert the studs 13 through the tube and under the plate 11. The screw 19 is then withdrawn so that the plate 9 comes into abutment against the top ends of the slots 15. At this stage, the spring 12 between the plates 9 and 11 is compressed while still retaining a compression margin. The electrical components are inserted into the tube 2 over the plate 9 and thus over the floating structure, after which, the tube loaded with the electrical components can be put into place inside a case.

As can be seen in the FIGURE, the fixing flange 20 for fixing the case 3 to a break chamber (not shown but extending perpendicularly to the axis D), e.g. of a circuit-breaker, is disposed in the middle of the case along the axis D so as to enable the case to be fixed in a T-disposition to the end of the chamber, thus disposing the closure resistor perpendicularly to the chamber. With this disposition, the lever arm exerted by the closure resistor on the end of the break chamber is considerably reduced. The end-to-end size of the break chamber is also reduced, and it is possible to place two or more stacks of electrical components 1 in parallel inside the case 3, and this can be done more easily than would have been possible if the length direction of the case 3 extended the axial direction of the break chamber.

The resistor assembly arrangement of the invention also provides simple access to the electrical components 1 for replacement purposes without it being necessary to act within the break chamber of the electrical gear that is connected to the resistor.

What is claimed is:

1. A closure resistor assembly for high voltage electrical gear, the assembly comprising:

a case having one end closed by a cover;

a multiplicity of resistive electrical components, disposed within said case and aligned in a row along an axis; and a mechanism which exerts a compression force on the resistive electrical components along the axis so as to maintain electrical contact between them, wherein the mechanism which exerts said compression force comprises a rigid tube disposed inside said case and within which said resistive electrical components are stacked, and an energy-storing floating structure placed inside the tube at one end of the row of said resistive electrical components, said floating structure being constituted by a first piece disposed between said end of the row of said resistive electrical components and a second piece that is mounted in a fixed manner inside the tube, together with a spring that is kept in compression between the first and second pieces, said first piece also being mounted so as to have limited movement between two abutments that are spaced-apart along the axis and that are constituted by the ends of a slot of the tube, said slot having passing therethrough a movable stud which is secured to said first piece.

2. The assembly according to claim 1, in which said second piece that is mounted in a fixed manner in the tube rests against further studs which pass through the tube and penetrate into the tube.

3. The assembly according to claim 1, in which the tube is placed in said case of generally cylindrical shape and in which a further stud is disposed between said cover and the other end of the row of resistive electrical components so that when the cover is closed, the further stud presses on said row of resistive electrical components so as to release the energy of the spring.

4. The assembly according to claim 3, in which the case has a fixing flange for fixing to a break chamber of high voltage electrical gear, said fixing flange being disposed in a central portion of the case in such a manner that once said fixing flange has been fixed to the break chamber, the row of resistive electrical components extends perpendicularly to the break chamber.

* * * * *